United States Patent [19]

Bredlau

[11] 4,170,354

[45] Oct. 9, 1979

[54] AMUSEMENT DEVICE

[76] Inventor: Kenneth A. Bredlau, 15675 LaBella Ct., Morgan Hill, Calif. 95037

[21] Appl. No.: 859,120

[22] Filed: Dec. 9, 1977

Related U.S. Application Data

[63] Continuation-in-part of Ser. No. 712,782, Aug. 9, 1976, Pat. No. 4,066,265.

[51] Int. Cl.[2] ..... A63F 9/06

[52] U.S. Cl. ..... 273/153 R

[58] Field of Search ..... 273/153 R, 240; 35/62

[56] References Cited

U.S. PATENT DOCUMENTS

| | | | |
|---|---|---|---|
| D. 28,047 | 12/1897 | Parmenter | 273/153 R X |
| 426,569 | 4/1890 | O'Shaughessy | 273/153 R |
| 984,302 | 2/1911 | Rosenberger | 273/240 X |
| 2,011,266 | 8/1935 | Boynton | 273/153 R |
| 3,179,414 | 4/1965 | Mertz et al. | 273/240 |

*Primary Examiner*—Anton O. Oechsle

*Attorney, Agent, or Firm*—Huebner & Worrel

[57] ABSTRACT

An amusement device comprising a maze card of laminated plastic construction having defined on the opposite faces thereof a singular path extending between the peripheral zone of the card and its center, and passing at least once therethrough via a gate or gates delineated by indicia.

1 Claim, 5 Drawing Figures

AMUSEMENT DEVICE

This application comprises a continuation-in-part application of application Ser. No. 712,782, filed Aug. 9, 1976, now U.S. Pat. No. 4,066,265.

BACKGROUND OF THE INVENTION

1. Field of the Invention

The invention generally relates to amusement devices and more particularly to an amusement device comprising a laminated plastic maze card having a singular path extended along both opposite faces of the card and passing at least once through the card, whereby a player is required to play both sides of the card in order to traverse the path.

2. Description of the Prior Art

The prior art is, of course, replete with amusement devices based upon the principle of a maze, and as can be appreciated, a maze may take any one of various forms. Frequently, amusement devices which utilize the principle of a maze are those which include a card having a myriad of path segments defined on one face of the card, and only a portion of which defines a singular path along the face. While such devices of this type are fascinating and tend to challenge and amuse players, the level of difficulty remains substantially fixed, due to the fact that after a period of practice, it becomes possible to analyze a maze when viewing it in its entirety.

Additionally, in instances where attempts have been made to increase the level of difficulty for amusement devices employing the principles of a maze, the resulting structure tends to be expensive to a degree such that its distribution often is prohibited in market areas requiring high-volume, low-cost products, particularly where the devices are of a construction which facilitates substantially continuous reuse.

It is therefore the general purpose of the instant invention to provide a practical and economic re-usable amusement device comprising a maze having an increased level of difficulty requiring of "players" skills of levels greater than those generally heretofore required in analyzing mazes of known devices, all without departing from the principles of the known maze or sacrificing the recreational benefits realized when "playing" a maze.

OBJECTS AND SUMMARY OF THE INVENTION

It is, therefore, an object of the instant invention to provide an improved amusement device.

It is another object to provide an economic, durable amusement device characterized by a maze having an increased level of difficulty.

It is another object to provide an economic amusement device including a maze card permanently encased in transparent laminae, whereby re-use is facilitated.

Another object is to provide an improved laminated maze card having a path segment defined on each of its opposite faces interconnected via at least one interconnecting gate.

Another object is to provide an improved, durable and economic amusement device comprising a laminated maze card having a singular path defined by a first and second plurality of path segments extended along the first and second faces of the card, respectively, and a plurality of gates interconnecting the first and second plurality of segments and the segments of each plurality.

Another object is to provide an improved amusement device comprising a maze card encased in transparent laminae having a singular path defined by a first and second plurality of path segments extended along the first and second faces of the card, respectively, and a plurality of gates interconnecting the first and second plurality of segments and the segments of each plurality, whereby a path through the maze can be traced using a marking device.

It is another object to provide an improved amusement device including a maze card having a maze path comprising a first plurality of interconnected path segments arranged on one face of the card, and a second plurality of interconnected path segments arranged on the opposite side of the card, and means defining at least one gate through the card for interconnecting the path segments, whereby there is provided a singular path which traverses the maze between its periphery and its center and passes at least once through the card, and transparent, hard-surfaces, stain resistant laminae encasing the card.

These together with other objects and advantages are realized through the use of a maze card of laminated plastic construction bearing indicia defining on the opposite faces thereof maze segments interconnected by gates which define a singular path extended between the center of the card and its periphery and passing at least once therethrough as will become more readily apparent by reference to the following description and claims in light of the accompanying drawings.

DESCRIPTION OF THE PREFERRED EMBODIMENT

Figure 1:
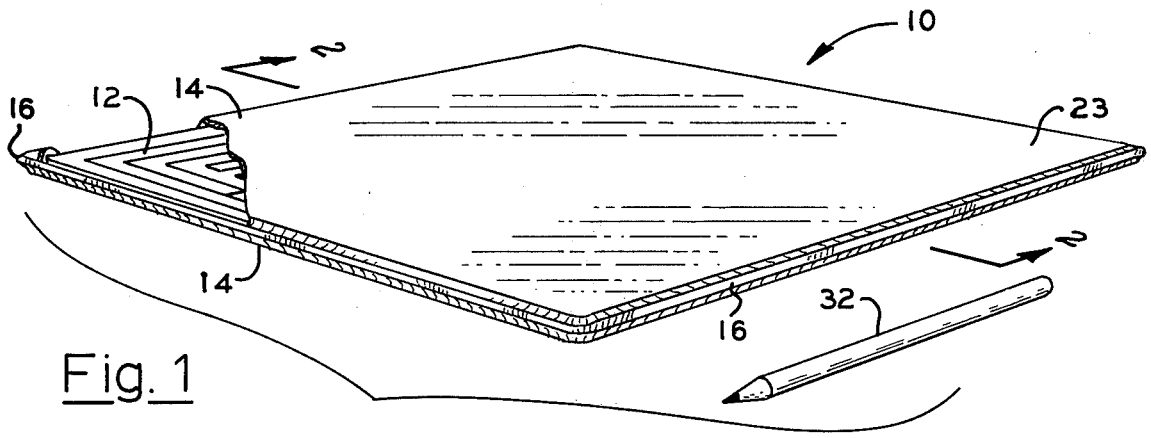
FIG. 1 is a fragmented top plan view of an amusement device comprising a laminated maze card which embodies the principles of the instant invention.
Figure 2:
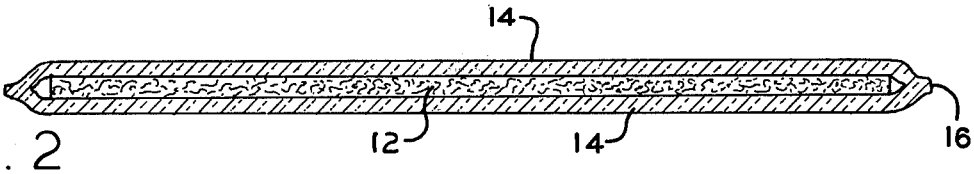
FIG. 2 is a cross-sectional view, taken generally along line 2—2 of FIG. 1.

Referring now to the drawings wherein like reference characters designate like or corresponding parts throughout the several views, there is shown in FIG. 1 an amusement device, generally designated 10, which comprises a preferred embodiment of the instant invention.

Figure 3:
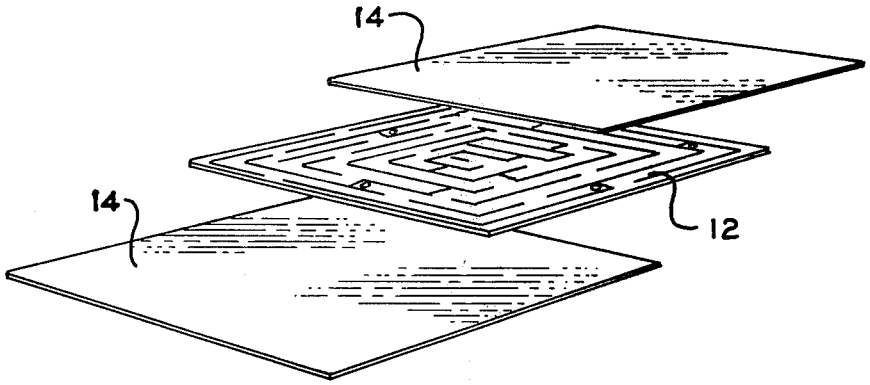
FIG. 3 is a perspective, exploded view of the device shown in FIG. 1.

The amusement device 10, as shown, includes a maze card 12 of laminated construction. Since techniques and materials employed in laminating cards are well-known, and are, of course, varied, a detailed description of the technique employed in fabricating the device 10 is omitted in the interest of brevity. However, to exemplify, it should be appreciated that the device 10 comprises a card 12 of laminated construction with the outer laminae 14 comprising films of transparent synthetic resin which cures to a substantially rigid state when sufficiently heated under pressure. The tool employed in laminating the card comprises a pressure applicator or mold, not shown, having suitably heated surfaces, and the card, where desired, is impregnated with a resin preparatory to being laminated. In order to effect the desired lamination of the card 12, between the laminae 14, the card is positioned between the layers of film, as depicted in FIG. 3, and placed in the tool. Upon being sufficiently heated under pressure the laminae are joined at least along their peripheries, for thus forming a continuous seal 16. Thus a laminated and, for all practical matter, permanently encased the maze card is formed.

Of course, other known laminating techniques, including those in which impregnation is omitted can be employed where so desired.

In any event, it is to be understood that the card 12 is sandwiched between a pair of opposed transparent laminae 14 disposed in mutually spaced parallel planes. The laminae 14 are formed of a rigid transparent material and are supported in mutually engaged relation, at least about the periphery of the card 12, for thus permanently encasing the card 12.

Figure 4:
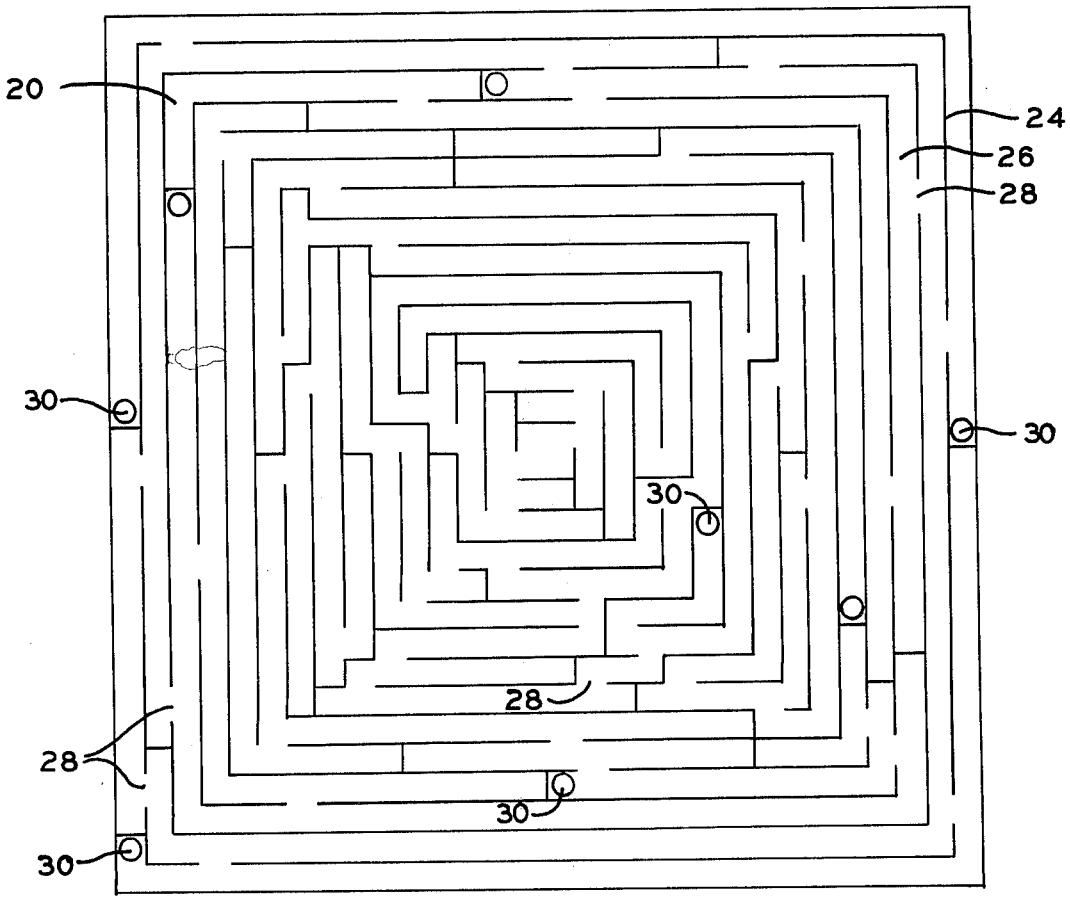
FIG. 4 is a top plan view of the maze card, with laminae omitted for clarity.
Figure 5:
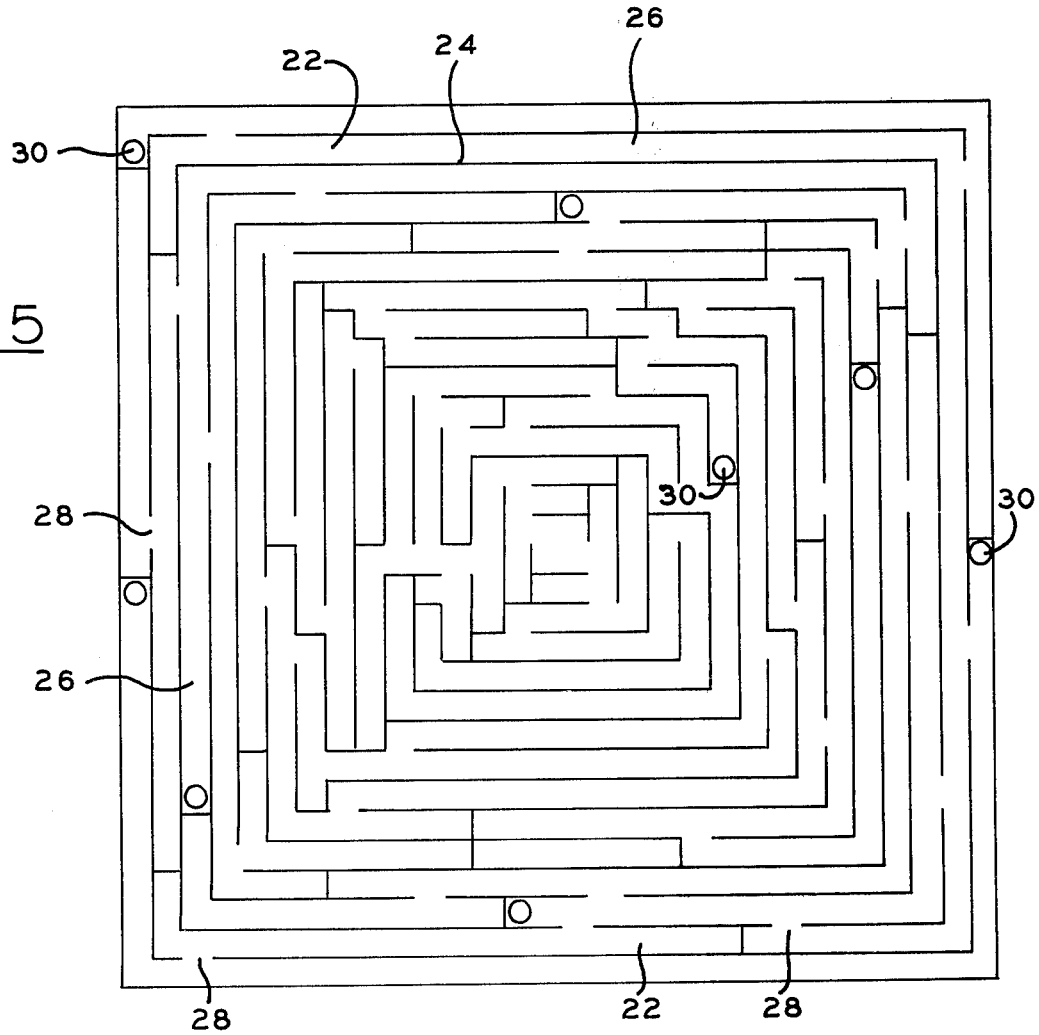
FIG. 5 is a bottom plan view of the maze card illustrated in FIG. 4 also depicting the device with the laminae omitted.

As best illustrated in FIGS. 4 and 5, the maze card 12, regardless of the technique employed for effecting a laminated construction is provided with a first planar face 20 and a second planar face 22. These, of course, are visible through the transparent laminae, the surface of which is designated 23. On each of the faces of the maze card 12, there is provided a plurality of lines 24. These lines serve to define a labyrinth of lesser path segments 26 which collectively form a segment of a maze pattern. The lesser segments thus formed on the opposite faces of the card are interconnected via a plurality of gates, designated 28. The gates 28 permit a player to simulate passage from one of the path segments 26 to an adjacent segment. Of course, any of the gates 28 may lead to a "dead end" while others collectively unite the segments 26 into a singular path, all in a manner consistent with the construction of known maze patterns.

As shown, the path segments 26 are so arranged that each face of the card 12 comprises mirror image of the other. However, such an arrangement is not necessarily desirable, particularly where an even greater level of difficulty is sought.

It is here noted that the segments of the maze pattern formed on opposite faces of the maze card are interconnected in communication. To achieve this, there is included in various ones of the path segments 26 indicia defining circles, designated 30. These circles represent gates through which imaginary access is afforded between the opposite faces of the card. It is to be understood that these gates are formed by registered indicia printed in a mutually opposed relation on the faces 20 and 22 of the card 12. However, where desired, apertures serve equally as well for this purpose.

In any event, the path segments 26, united by gates 28, which appear at opposite faces of the maze card 12 are, in turn, interconnected by the gates for thus completing a singular path. The singular path thus completed extends between the periphery of the maze card and terminates near the center thereof. As should now be apparent, the path thus completed also passes at least once through the maze card 12, at a gate. Of course, the lines 24 are in practice so arranged that the path defined by the path segments 26 passes through the card several times so that a player is required to traverse successive portions of a singular path along opposite faces of the card 12 before completing passage through the maze.

As illustrated in FIG. 1, the amusement device also includes a marking device, designated 32, such as a grease pencil, crayon or the like. This device is provided to be employed for applying removable marks on the surfaces 23 of the laminae 14. In "playing" the amusement device 10, a player simply traces a continuous path, beginning at a selected point on one surface 23 of the device 10, which passes along path segments 26, through selected gates 28 until an appropriate circle 30, indicating a gate, is reached. At a point adjacent this gate the player terminates marking on that surface 23 and the card is reversed about an axis lying in the plane thereof. The player now resumes tracing a path on the opposite surface of the card, beginning a point adjacent the gate at which prior tracing was terminated. This process is repeated for as often as is necessary for a player to trace its way through the maze while traversing a singular path between the periphery of the maze and its center.

In view of the foregoing, it should readily be apparent that the amusement device which embodies the principles of the instant invention comprises an economic, durable device including a unitary maze card of laminae construction characterized by an increased level of difficulty capable of challenging players of substantial skill. Moreover, because of its economic and durable characteristics, the maze card 12 may be supplied as one card of a deck of such cards and repeatedly employed for amusement purposes. Moreover, the device lends itself to competition between multiple players, and may be re-used as often as desired, since grease pencil markings may be completely erased from the face of the card.

Although the invention has been herein shown and described in what is conceived to be the most practical and preferred embodiment is is recognized that departures may be made therefrom within the scope of the invention, which is not to be limited to the illustrative details disclosed.

Having described my invention, what I claim as new and desire to secure by Letters Patent is:

1. An amusement device of laminated construction comprising in combination:

A. a maze card including a pair of oppositely related planar faces having indicia printed thereon for defining on the faces a singular path extending between the periphery of the card and its center including a plurality of straight lines arranged in both parallel and intersecting relation for forming a labyrinth of segments of said path, said lines being characterized by hiatuses defining first gate means joining adjacently related path segments on each of the oppositely related faces, further indicia defining on each of said faces a plurality of dots disposed in said path segments, at least one dot on each face being registered with a dot on the other face of the card for defining at least one second gate means between the faces for connecting segments of the path in communication;

B. laminae for transparent synthetic resin sandwiching said card therebetween; and C. a marking device for applying removeable tracing marks to the surface of the laminae.

* * * * *